US011125417B2

(12) United States Patent
Shen et al.

(10) Patent No.: US 11,125,417 B2
(45) Date of Patent: Sep. 21, 2021

(54) FOCUS-ADJUSTABLE LIGHTING DEVICE

(71) Applicant: XIAMEN SAN'AN OPTOELECTRONICS CO., LTD., Xiamen (CN)

(72) Inventors: Xiqiang Shen, Xiamen (CN); Linchuan Zhang, Xiamen (CN); Hongbin Zhang, Xiamen (CN); Chaodong Xie, Xiamen (CN); Chihwei Chao, Xiamen (CN)

(73) Assignee: Xiamen San'An Optoelectronics Co., Ltd., Xiamen (CN)

( * ) Notice: Subject to any disclaimer, the term of this patent is extended or adjusted under 35 U.S.C. 154(b) by 0 days.

(21) Appl. No.: 16/929,538

(22) Filed: Jul. 15, 2020

(65) Prior Publication Data

US 2020/0348008 A1 Nov. 5, 2020

Related U.S. Application Data

(63) Continuation-in-part of application No. PCT/CN2018/116515, filed on Nov. 20, 2018.

(51) Int. Cl.
*F21V 14/04* (2006.01)
*F21V 5/04* (2006.01)
(Continued)

(52) U.S. Cl.
CPC ..... *F21V 14/04* (2013.01); *F21V 5/045* (2013.01); *F21V 7/06* (2013.01); *F21Y 2115/10* (2016.08)

(58) Field of Classification Search
CPC . F21V 14/04; F21V 5/045; F21V 7/06; F21V 17/02; F21V 14/06; F21V 13/04;
(Continued)

(56) References Cited

U.S. PATENT DOCUMENTS 5,735,594 A * 4/1998 Own ..... F21L 4/00 362/188
6,224,236 B1 * 5/2001 Shu ..... F21L 2/00 362/109
(Continued)

FOREIGN PATENT DOCUMENTS

CN 205424659 U 8/2016
CN 207486576 U 6/2018

OTHER PUBLICATIONS

Search Report issued to PCT application No. PCT/CN2018/116515 by the WIPO dated Aug. 20, 2019.

*Primary Examiner* — Bao Q Truong
(74) *Attorney, Agent, or Firm* — Rosenberg, Klein & Lee

(57) ABSTRACT

A focus-adjustable lighting device includes a housing, a light source module, a focus-adjustable mechanism, and a light guiding unit. The focus-adjustable mechanism includes a rotating member and a first limiting member. The rotating member is rotatable relative to the housing, and has a semi-helical guide groove, and an engaging unit that includes a plurality of spaced-apart concave grooves corresponding in position to the semi-helical guide groove. The first limiting member includes a first limiting portion disposed in the semi-helical guide groove, and a second limiting portion spaced apart from the first limiting portion. The light guiding unit is movable with the rotating member.

24 Claims, 14 Drawing Sheets

(51) Int. Cl.
*F21V 7/06* (2006.01)
*F21Y 115/10* (2016.01)

(58) Field of Classification Search
CPC ..... F21V 5/048; F21V 14/045; F21V 14/00; F21V 21/14; F21V 21/145; F21V 14/065; F21Y 2115/10
See application file for complete search history.

(56) References Cited

U.S. PATENT DOCUMENTS

2010/0135013 A1* 6/2010 Chiang ..... F21V 7/005 362/235
2016/0195245 A1* 7/2016 Markey ..... F21S 8/026 362/147

* cited by examiner

FOCUS-ADJUSTABLE LIGHTING DEVICE

CROSS-REFERENCE TO RELATED APPLICATION

This application is a continuation-in-part application of PCT International Application No. PCT/CN2018/116515 filed on Nov. 20, 2018. The entire content of the international patent application is incorporated herein by reference.

FIELD

The present disclosure relates to a lighting device, and more particularly to a lighting device capable of accurately adjusting focus.

BACKGROUND

The International Commission on Illumination stipulates a beam angle (see FIG. 1) as the angle between two imaginary lines in a plane through an optical beam axis, such that these lines pass through the center of the front face of a light source and through points at which the luminous intensity is 50% of the center beam intensity. The beam angle reflects the size and light intensity of the light spot of the light source. The same light source will produce different lighting effects under different beam angles. Based on the different sites and conditions of usage, a light source, such as a lamp, is required to produce different lighting effects. For example, a zoom lamp can produce different lighting effects by adjusting the focal length to meet various lighting requirements under different conditions of usage.

However, an existing zoom lamp has several drawbacks, such as unstable focus adjustment, low zoom accuracy, cannot accurately zoom, etc.

SUMMARY

Therefore, an object of the present disclosure is to provide a focus-adjustable lighting device that can alleviate at least one of the drawbacks of the prior art.

According to the present disclosure, a focus-adjustable lighting device includes a housing, a light source module, a focus-adjustable mechanism, and a light guiding unit. The housing includes a surrounding wall that has an inner surrounding surface and an outer surrounding surface, and a mounting plate that extends inwardly and radially from the inner surrounding surface. The light source module is mounted in the mounting plate for emitting light. The focus-adjustable mechanism includes a rotating member and a first limiting member. The rotating member is disposed on and rotatable relative to the housing, and has an inner surface, an outer surface opposite to the inner surface, a semi-helical guide groove formed in the inner surface, and an engaging unit provided immediately adjacent to the semi-helical guide groove. The engaging unit includes a plurality of spaced-apart concave grooves that are formed in the inner surface and that correspond in position to the semi-helical guide groove. The first limiting member is fixed on the housing and includes a first limiting portion that is disposed in the semi-helical guide groove, and a second limiting portion spaced apart from the first limiting portion. The light guiding unit is disposed on and movable with the rotating member for reflecting light emitted from the light source module. When the rotating member is rotated relative to the housing, the first limiting portion slides along the semi-helical guide groove to control a distance between the light guiding unit and the light source module, and the second limiting portion engages one the concave grooves to restrict a stepwise rotation of the rotating member.

BRIEF DESCRIPTION OF THE DRAWINGS

Other features and advantages of the present disclosure will become apparent in the following detailed description of the embodiments with reference to the accompanying drawings, of which.

DETAILED DESCRIPTION

Figure 1:
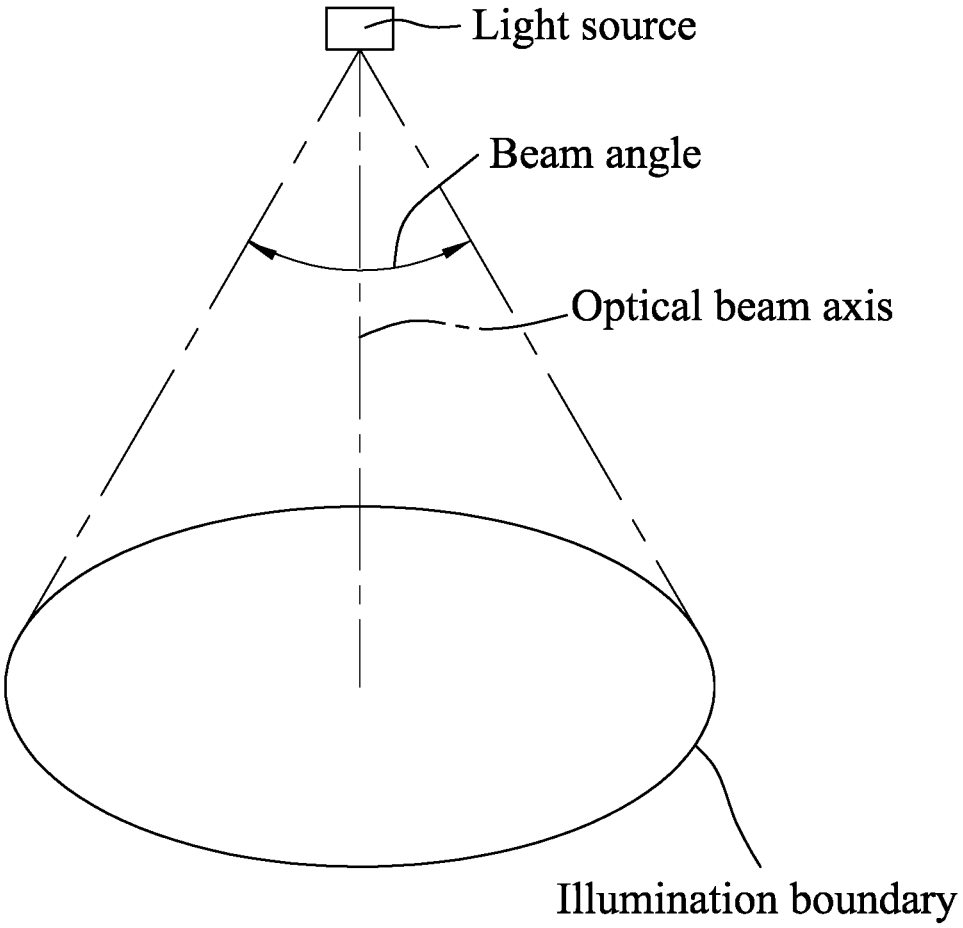
FIG. 1 is a schematic view illustrating a beam angle as stipulated by the International Commission on Illumination.

Before the present disclosure is described in greater detail, it should be noted that where considered appropriate, reference numerals or terminal portions of reference numerals have been repeated among the figures to indicate corresponding or analogous elements, which may optionally have similar characteristics.

Figure 2:
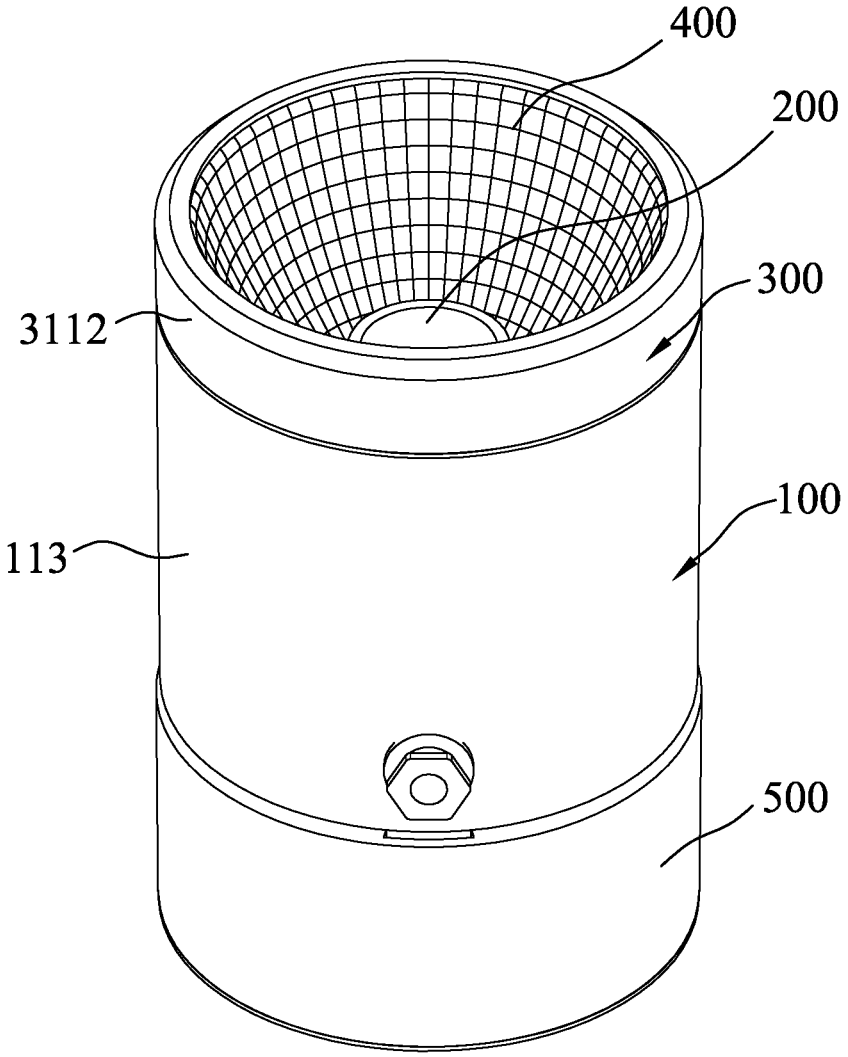
FIG. 2 is a perspective view of a first embodiment of a focus-adjustable lighting device according to the present disclosure.
Figure 3:
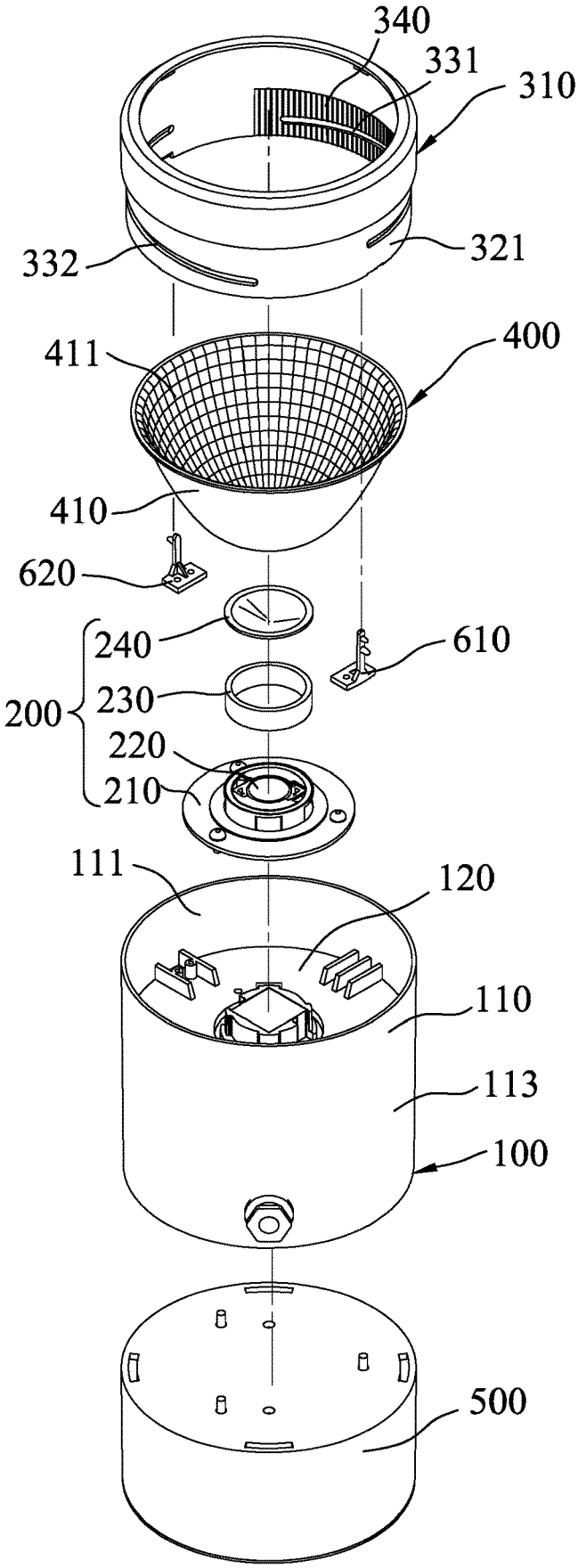
FIG. 3 is an exploded perspective view of the first embodiment.

Referring to FIGS. 2 and 3, a focus-adjustable lighting device according to a first embodiment of the present disclosure includes a housing 100, a light source module 200, a focus-adjustable mechanism 300, a light guiding unit 400, and a power driver 500. The focus-adjustable lighting device of this disclosure is exemplified as a track light having a beam angle ranging from 20° to 40°, but is not limited thereto, and may be an aluminum reflector light, a parabolic aluminum reflector light, a downlight, etc.

The housing 100 includes a surrounding wall 110 having an inner surrounding surface 111 and an outer surrounding surface 113, and a mounting plate 120 extending inwardly and radially from the inner surrounding surface 111.

The light source module 200 is mounted on the mounting plate 120 for emitting light. The focus-adjustable mechanism 300 and the light guiding unit 400 are positioned along an irradiation direction of of the light source module 200. The power driver 500 is mounted on a bottom portion of the housing 100, and is electrically connected to the light source module 200. In this embodiment, the light source module 200 includes a chip-on-board (COB) laminate 210 electrically connected to the power driver 500, a light emitting diode (LED) package 220 mounted on the chip-on-board laminate 210 and having a top portion 221 (see FIGS. 10 and 11), a light-transmitting glass ring 230, and a light source reflector 240. The light-transmitting glass ring 230 is disposed on the top portion 221 of the LED package 220. The light source reflector 240 exemplified in this embodiment is an anti-glare reflection cup, and is fixed on top of the light-transmitting glass ring 230 to be disposed spacedly above the LED package 220 so as to provide enhanced reliability. Specifically, the light-transmitting glass ring 230 is connected between the top portion 221 of the LED package 220 and the light source reflector 240. The light source reflector 240 may have a diameter ranging from 10 mm to 50 mm, preferably 20 mm to 30 mm, so as to achieve a good anti-glare effect. The light-transmitting glass ring 230 is preferably made of quartz glass having a high transmittance, and has a diameter ranging from 10 mm to 50 mm, and a height ranging from 3 mm to 20 mm, preferably 5 mm to 10 mm, so as to achieve a good focusing effect.

Figure 4:
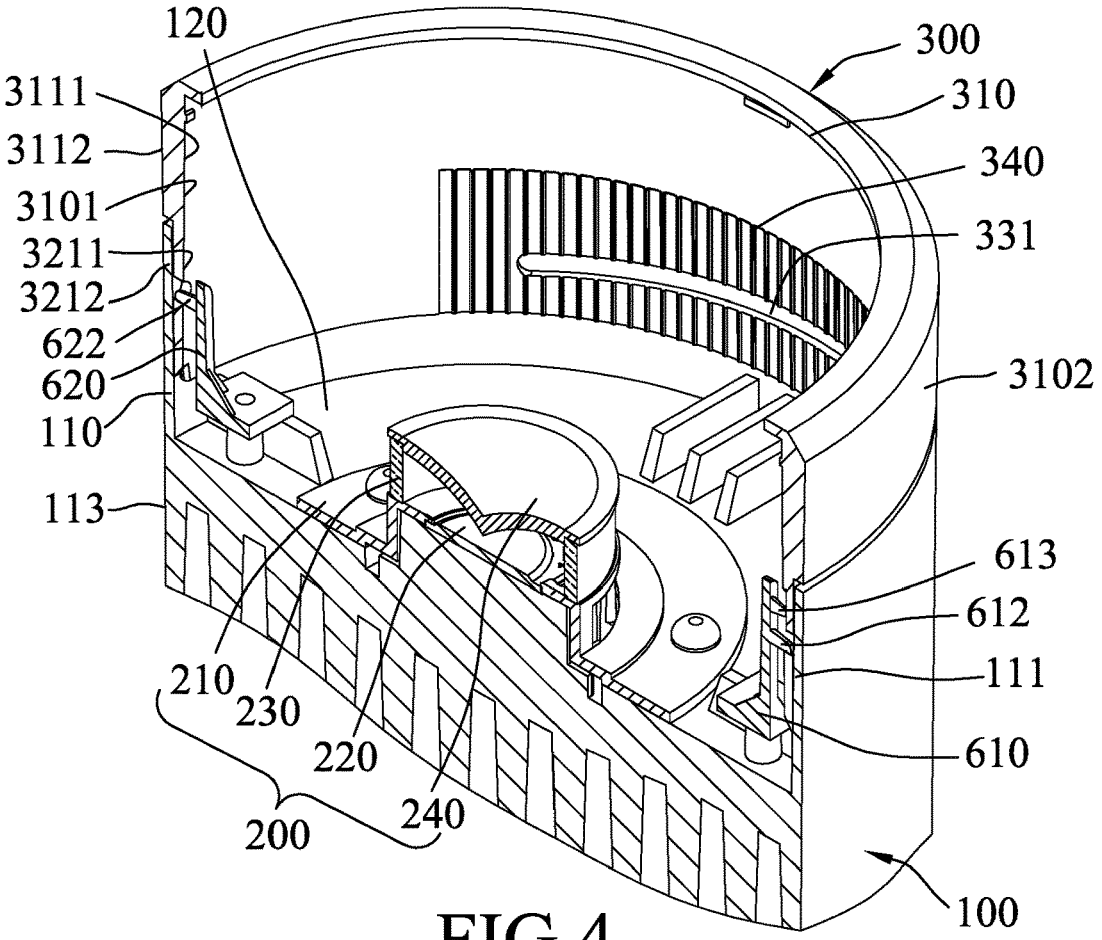
FIG. 4 is a partial perspective view of an assembly of a housing, a light source module and a focus-adjustable mechanism of the first embodiment.
Figure 5:
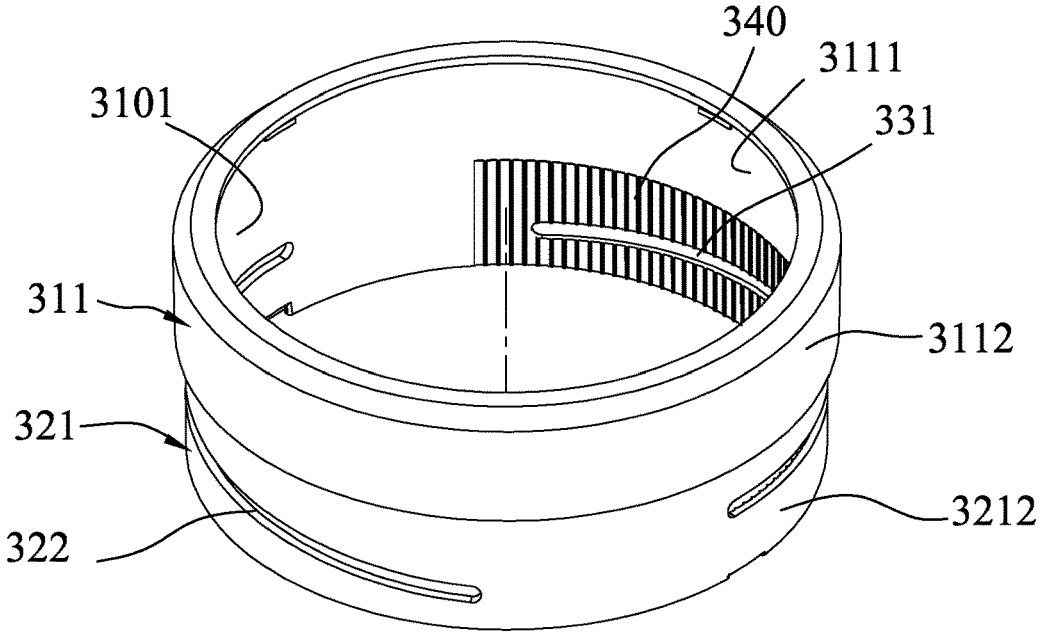
FIG. 5 is a perspective view of a rotating member of the focus-adjustable mechanism of the first embodiment.

Referring to FIGS. 4 and 5, the focus-adjustable mechanism 300 includes a rotating member 310, a first limiting member 610, and a second limiting member 620. The rotating member 310 is disposed on and covers a top portion of the housing 100. Specifically, the rotating member 100 is rotatable relative to the housing 100, and has an inner surface 3101, an outer surface 3102 opposite to the inner surface 3101, a semi-helical guide groove 331 formed in the inner surface 3101, and an engaging unit 340 provided immediately adjacent to the semi-helical guide groove 331. Further, the rotating member 310 is a hollow cylindrical structure, and includes an upper portion 311 and a lower portion 321. The upper portion 311 has an upper inner surface 3111 forming a part of the inner surface 3101, and an upper outer surface 3112 forming a part of the outer surface 3102. The lower portion 321 has a lower inner surface 3211 forming the other part of the inner surface 3101, and a lower outer surface 3212 forming the other part of the outer surface 3102. The semi-helical guide groove 331 of this embodiment is formed in the upper inner surface 3111.

The rotating member 310 further has a semi-helical guide slot 332 formed in the lower portion 321 and extending through the lower inner surface 3211 and the lower outer surface 3212. The semi-helical guide slot 332 is diametrically opposite to the semi-helical guide groove 331. The upper portion 311 has an outer diameter greater than that of the lower portion 312. That is, the lower portion 312 extends inwardly and downwardly from a lower peripheral end of the upper portion 311. During assembly, the lower portion 321 of the rotating member 310 is inserted into the top portion of the housing 100 and the upper outer surface 3112 is flush with the outer surrounding surface 113 of the surrounding wall 110 of the housing 100 (see FIGS. 2 and 4).

Figure 6:
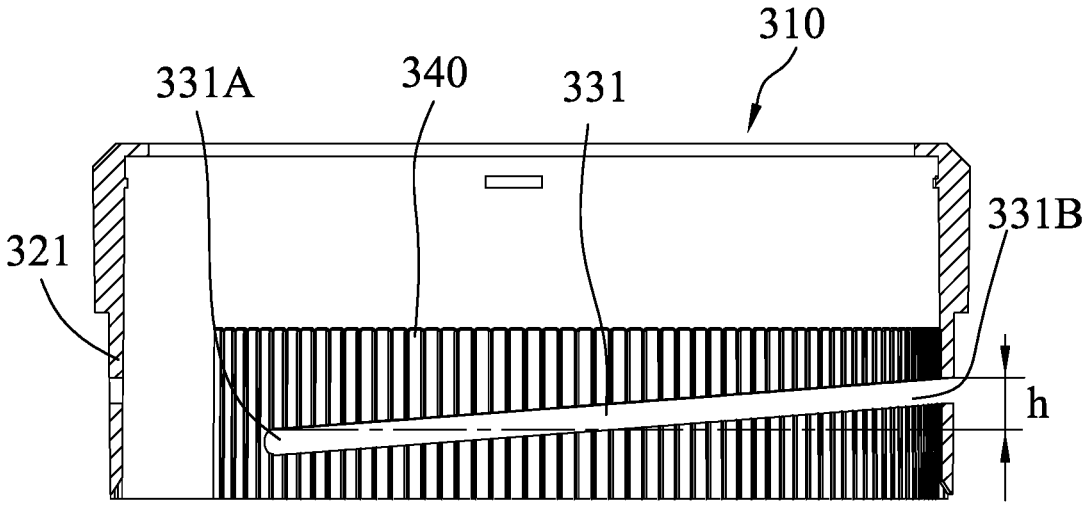
FIG. 6 is a partial perspective view of the rotating member of the first embodiment.

Referring to FIG. 6, in combination with FIG. 4, the semi-helical guide groove 331 has an arc length less than half of a circumference of the rotating member 310, but larger than zero. In this embodiment, the arc length of the semi-helical guide groove 331 is greater than one third of the circumference of the rotating member 310, but less than half of the circumference of the rotating member 310, so as to reduce shaking of the rotating member 310 during rotation thereof. The semi-helical guide groove 331 has a lower end portion (331A) proximate to the mounting plate 120, and an upper end portion (331B) distal to the mounting plate 120. The lower end portion (331A) and the upper end portion (331B) has a height difference (h) of less than 20 mm. In this embodiment, the height difference (h) between the lower end portion (331A) and the upper end portion (331B) ranges from 3 mm to 20 mm. When the height difference (h) is too small, adjustment of the range of beam angle is relatively limited. When the height difference (h) is too large, improvement in the accuracy of focus-adjustment is not conducive and easily cause shaking, resulting in reduced lighting efficiency.

Figure 7:
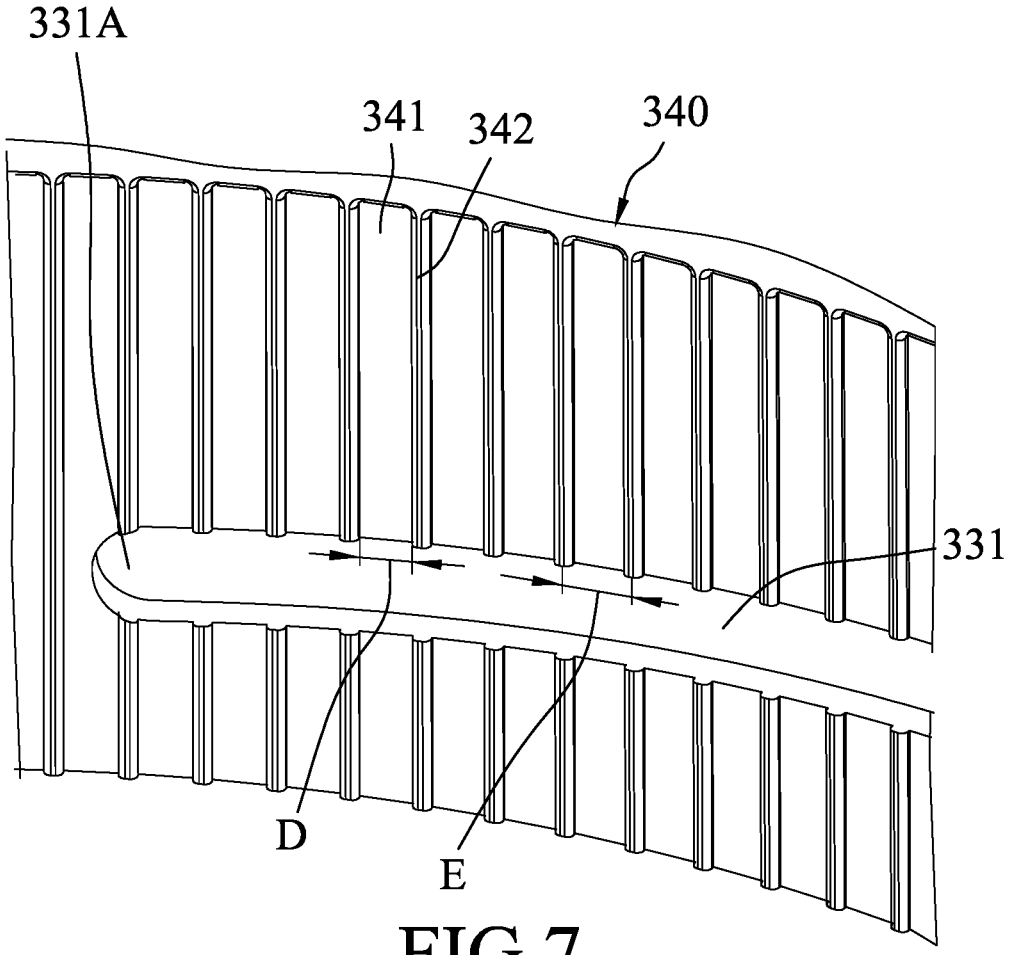
FIG. 7 is a fragmentary enlarged perspective view of an engaging unit of the rotating member of the first embodiment.
Figure 8:
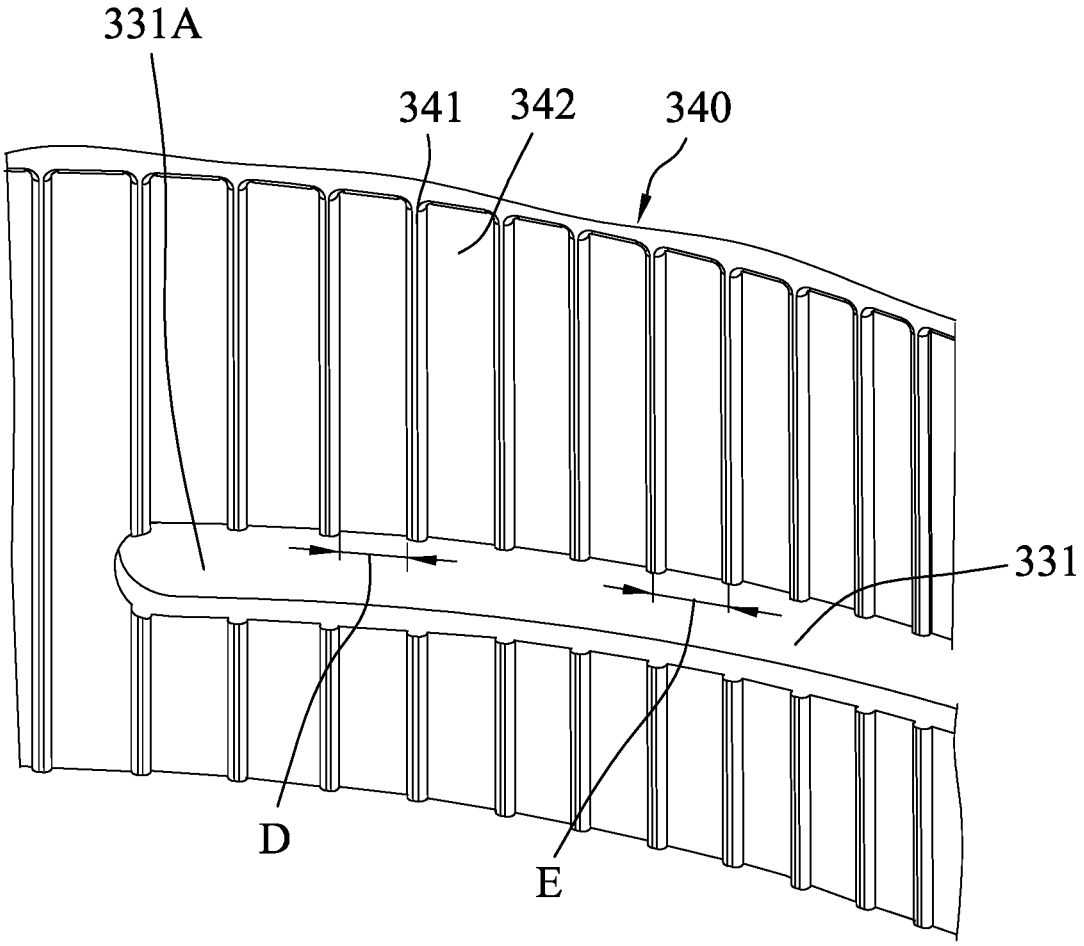
FIG. 8 is a view similar to FIG. 7, but illustrating an alternative form of the engaging unit.

Referring to FIG. 7, in combination with FIGS. 4 and 6, the engaging unit 340 includes a plurality of alternating concave grooves 341 and ribs 342. The concave grooves 341 are formed spaced apart from one another in the upper inner surface 3111 and corresponding in position to the semi-helical guide groove 331. The concave grooves 341 may be located above or below the semi-helical guide groove 331, or above and below the semi-helical guide groove 331, as shown in FIGS. 4 and 6. The concave grooves 341 extend transverse to the semi-helical guide groove 331 (i.e., the concave grooves 341 and the semi-helical guide groove 331 are not parallel to each other), and are perpendicular to the mounting plate 120 of the housing 100. In this embodiment, each of the concave grooves 341 has a width (D) ranging from 1 mm to 20 mm. However, in other embodiments, the width (D) of each concave groove 341 may range from 1 mm to 5 mm, 5 mm to 10 mm, or 10 mm to 20 mm. In this embodiment, the concave grooves 341 have a same width (D). In other embodiments, the concave grooves 341 may have gradually changing widths (D). For example, the widths (D) of the concave grooves 341 may gradually decrease from the lower end portion (331A) to the upper end portion (331B), as shown in FIG. 8.

Each of the ribs 342 is disposed between two adjacent ones of the concave grooves 341. In this embodiment, each two adjacent ones of the ribs 342 are equally spaced apart from each other by a distance (E), which may range from 1 mm to 20 mm. However, in other embodiments, the distance (E) may range from 1 mm to 5 mm, 5 mm to 10 mm, or 10 mm to 20 mm. Further, in other embodiments, the ribs 342 may have gradually decreasing distances (E) from the lower end portion (331A) to the upper end portion (331B) (see FIG. 8).

Figure 9:
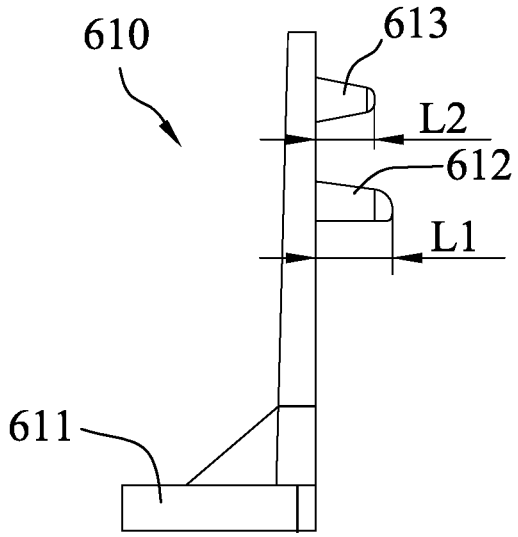
FIG. 9 is a perspective view of a first limiting member of the focus-adjustable mechanism of the first embodiment.
Figure 10:
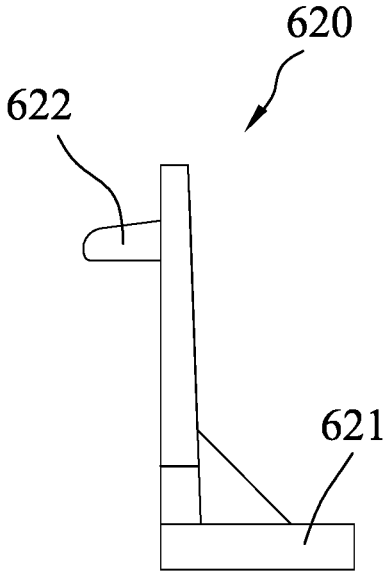
FIG. 10 is a perspective view of a second limiting member of the focus-adjustable mechanism of the first embodiment.

Referring to FIGS. 9 and 10, in combination with FIGS. 3 to 5, the first and second limiting members 610, 620 are fixed on the mounting plate 120 of the housing 100, and are located opposite to each other within the rotating member 310. The first limiting member 610 includes a first limiting portion 612 disposed in the semi-helical guide groove 331, and a second limiting portion 613 spaced apart from the first limiting portion 610. The first and second limiting portions 612, 613 may be a horizontal guide column or protrusion. In this embodiment, the first limiting portion 612 and the second limiting portion 613 are parallel to each other, and the second limiting portion 613 is positioned above the first limiting portion 612. In other embodiments, the second limiting portion 613 may be positioned below the first limiting portion 612. The first limiting portion 612 has a length (L1) greater than a length (L2) of the second limiting portion 613. In this embodiment, the second limiting portion 613 is made of an elastic material, such as a metal or plastic elastic piece.

The second limiting member 620 includes a third limiting portion 622 disposed in the semi-helical guide slot 332. The third limiting portion 622 may also be a horizontal guide column or protrusion. Each of the first and second limiting members 610, 620 further includes a connecting portion 611, 621 fixedly connected to the mounting plate 120.

Figure 11:
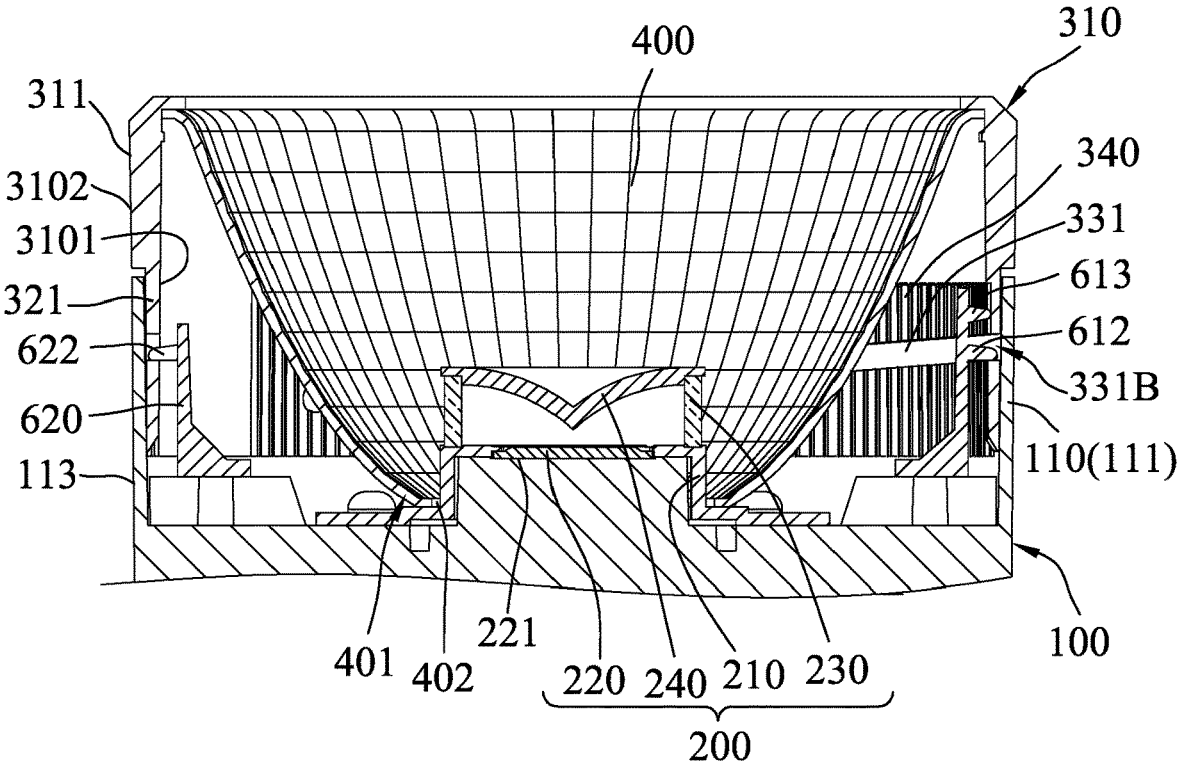
FIG. 11 is a partial sectional view of the first embodiment, but without a power driver.
Figure 12:
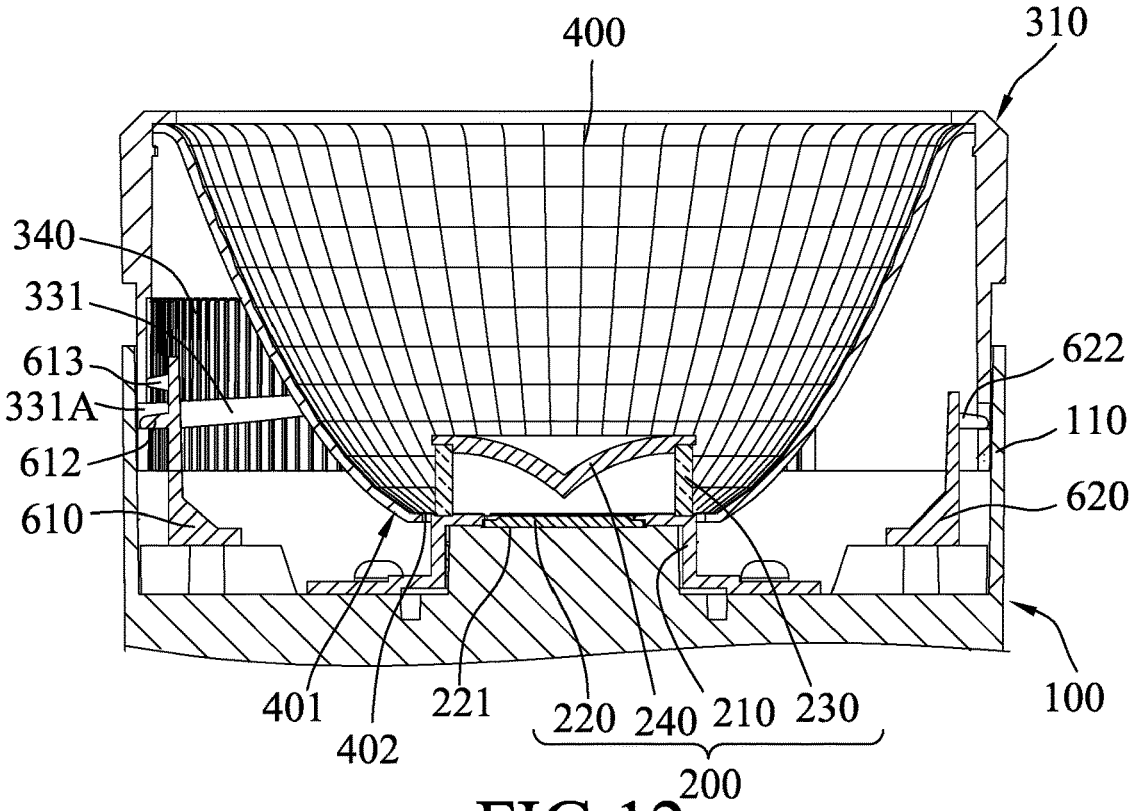
FIG. 12 is a view similar to FIG. 10, but with a light guiding unit in a highest position relative to the housing.

Referring to FIGS. 11 and 12, in combination with FIGS. 2 and 3, the light guiding unit 400 is disposed on and movable with the rotating member 310 for reflecting light emitted from the light source module 200. The light guiding unit 400 includes a reflective cup 410 fixedly connected to the upper portion 311 of the rotating member 310. The reflective cup 410 defines a receiving space 411, and has a bottom portion 401 formed with an opening 402 that communicates with the receiving space 411 for insertion of the light source module 200 into the receiving space 411.

In use, when the rotating member 310 is rotated relative to the housing 100, the first limiting portion 612 and the third limiting portion 622 respectively slide along the semi-helical guide groove 331 and the semi-helical guide slot 332 to control a distance between the light guiding unit 400 and the light source module 200, so as to change the size of the beam angle and the light spot of the light source module 200, and the second limiting portion 613 engages one of the concave grooves 341 to restrict a stepwise rotation of the rotating member 310. To be specific, the length of the semi-helical guide groove 331 can be adjusted according to the design of the rotating member 310, and can be precisely converted into an adjustable vertical height. At the same time, the engaging unit 340 can be provided above or below the semi-helical guide groove 331 for engagement of the second limiting portion 613 with one of the concave grooves 341 of the engaging unit 340 so as to restrict a stepwise rotation of the rotating member 310, allowing angular rotation of the rotating member 310 to be easily controlled, thereby facilitating precise adjustment of the beam angle.

In addition, when the second limiting portion 613 is restricted in one of the concave grooves 341 that is disposed between two adjacent ones of the ribs 342, and when the rotating member 310 is rotated relative to the housing 100, the second limiting portion 613 moves from one of the concave grooves 341 to an adjacent one of the concave grooves 341 and collides with a corresponding one of the ribs 342 to emit sound as the second limiting portion 613 moves from the one of the concave grooves 341 to the adjacent one of the concave grooves 341.

As shown in FIG. 11, when the rotating member 310 is rotated relative to the housing 100 and moves the reflective cup 410 to a lowest position relative to the housing 100, the first limiting portion 612 is positioned at the upper end portion (331B) of the semi-helical guide groove 331, the light source module 200 is located within the receiving space 411 of the reflective cup 410, and the bottom portion 401 of the reflective cup 41 is lower than the top portion 221 of the LED package 220. As shown in FIG. 12, when the rotating member 310 is rotated relative to the housing 100 and moves the reflective cup 410 to a highest position relative to the housing 100, the first limiting portion 612 is positioned at the lower end portion (331A) of the semi-helical guide groove 331, and the bottom portion 401 of the reflective cup 410 is flush with the top portion 221 of the LED package 220.

Figure 13:
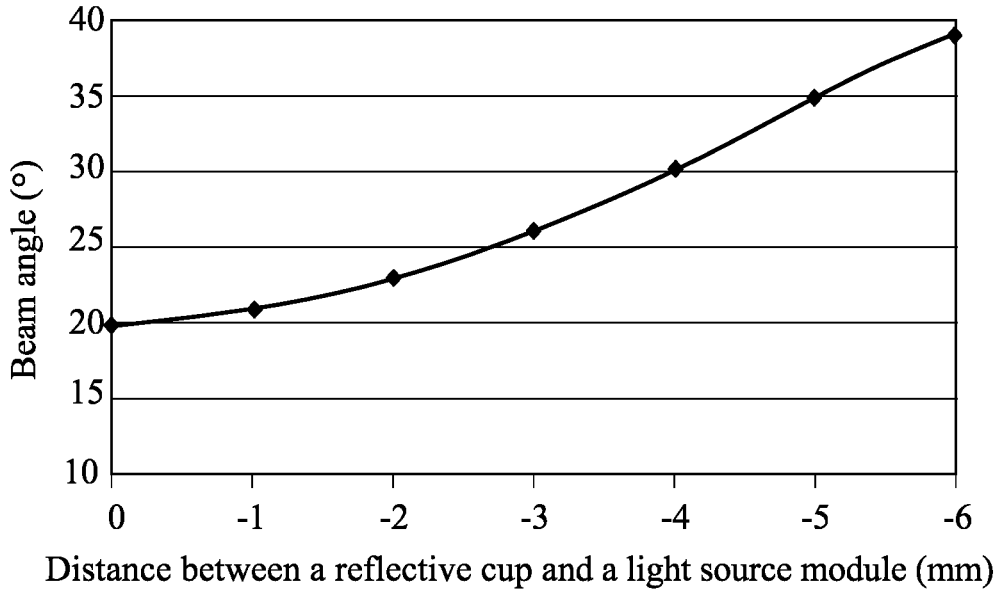
FIG. 13 is a graph illustrating beam angle versus different positions of the light guiding unit of the first embodiment.
Figure 14:
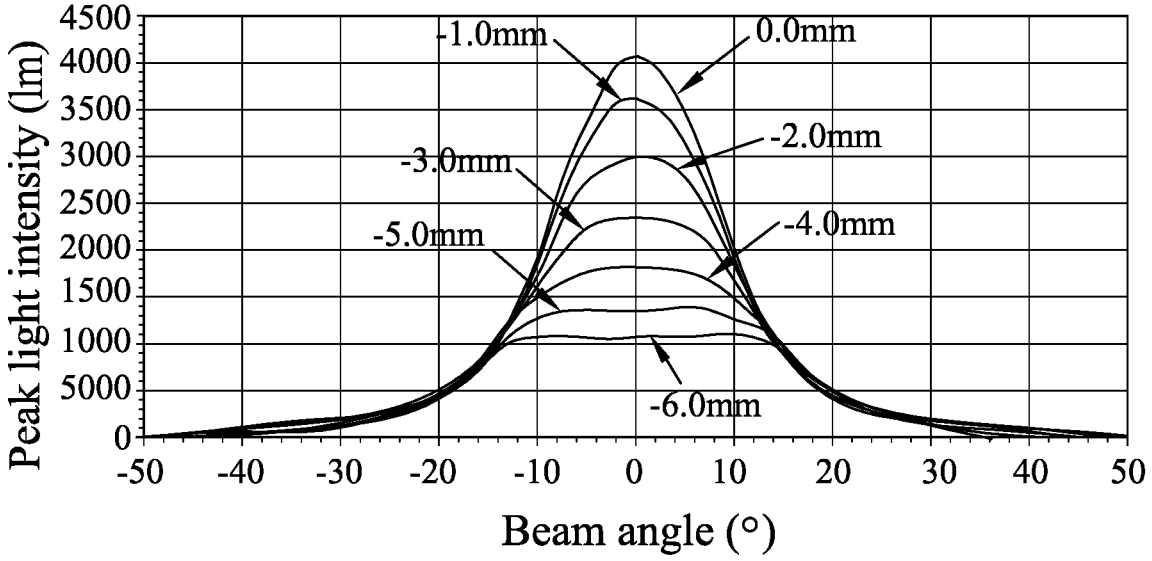
FIG. 14 is a graph illustrating beam angle versus peak light intensity under different positions of the light guiding unit of the first embodiment.

FIG. 13 is a graph illustrating beam angle versus distance of the reflective cup 410 relative to the light source module 200, i.e., changes in the beam angle of the focus-adjustable lighting device of the present disclosure at different positions of the reflective cup 410 of the light guiding unit 400 relative to the light source module 200. When the lower end portion (331A) and the upper end portion (331B) of the semi-helical guide groove 331 have a height difference (h) of 6 mm, the rotating member 310 can be rotated to move the reflective cup 410 to a height distance of 6 mm, so that the beam angle of the focus-adjustable lighting device of this disclosure can be adjusted to range between 20° and 40°. With the flush position of the bottom portion 401 of the reflective cup 410 and the top portion 221 of the LED package 220 being used as a reference point (0 point), as shown in FIG. 12, when the rotating member 310 is rotated downwardly to a position shown in FIG. 11, the slope of the curve of the beam angle gradually becomes larger. Based on such curve, the width (D) of each of the concave grooves 341 and the distance (E) between each two adjacent ones of the ribs 342 of the engaging unit 340 may be further designed. In this embodiment, the concave grooves 341 (or the ribs 342) are equally spaced apart from one another, so that an equal stepwise rotation of the rotating member 310 can be performed when the rotating member 310 together with the reflective cup 410 is rotated relative to the housing 100 (i.e., the second limiting portion 613 moves from one of the concave grooves 341 to an adjacent one of the concave grooves 341), thereby gradually adjusting the angle of the light beam generated from the light source module 200. In other embodiments, the concave grooves 314 (or the ribs 342) may not be equally spaced apart from one another, e.g., the widths (D) of the concave grooves 341 [or the distances (E) of the ribs 342] may gradually decrease or increase from the lower end portion (331A) to the upper end portion (331B) of the semi-helical guide groove 331, so that an unequal stepwise rotation of the rotating member 310 can be performed when the rotating member 310 together with the reflective cup 410 is rotated relative to the housing 100, thereby equally adjusting the angle of the light beam generated from the light source module 200. FIG. 14 is a graph illustrating beam angle versus peak light intensity, i.e., changes in the beam angle and the peak light intensity of the focus-adjustable lighting device of the present disclosure at different positions of the reflective cup 410 of the light guiding unit 400.

Figure 15:
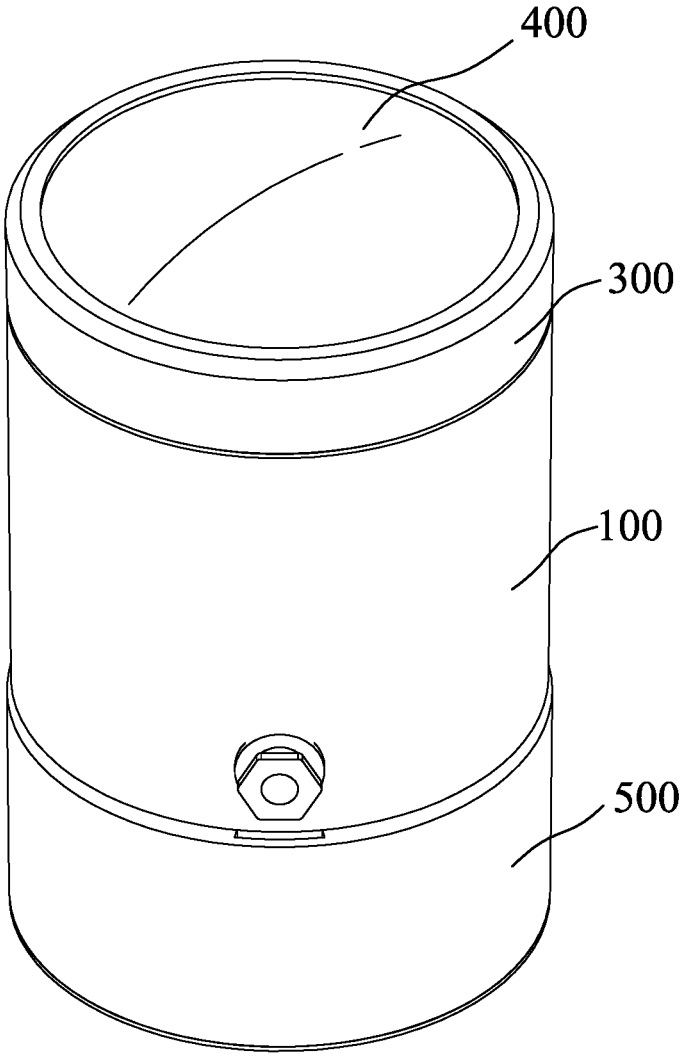
FIG. 15 is a perspective view of a second embodiment of the focus-adjustable lighting device according to the present disclosure.
Figure 16:
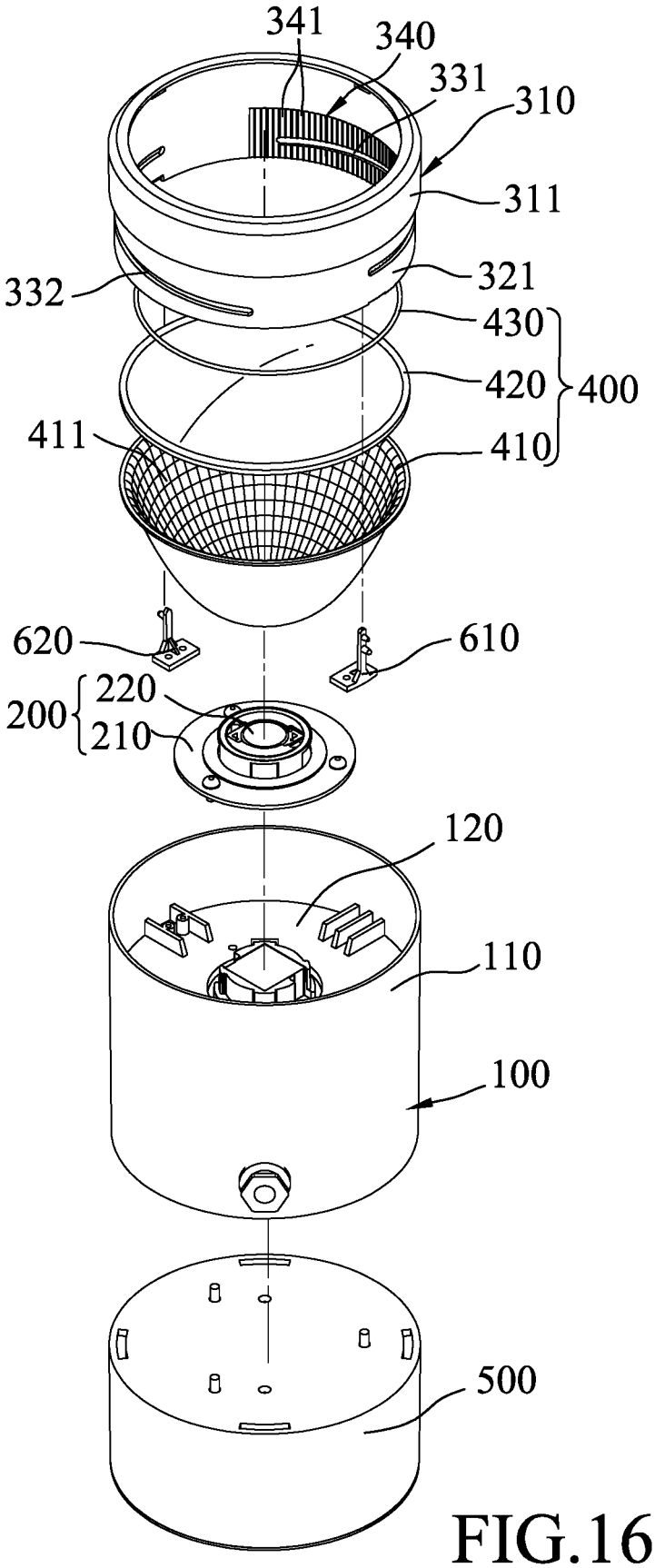
FIG. 16 is an exploded perspective view of the second embodiment.
Figure 17:
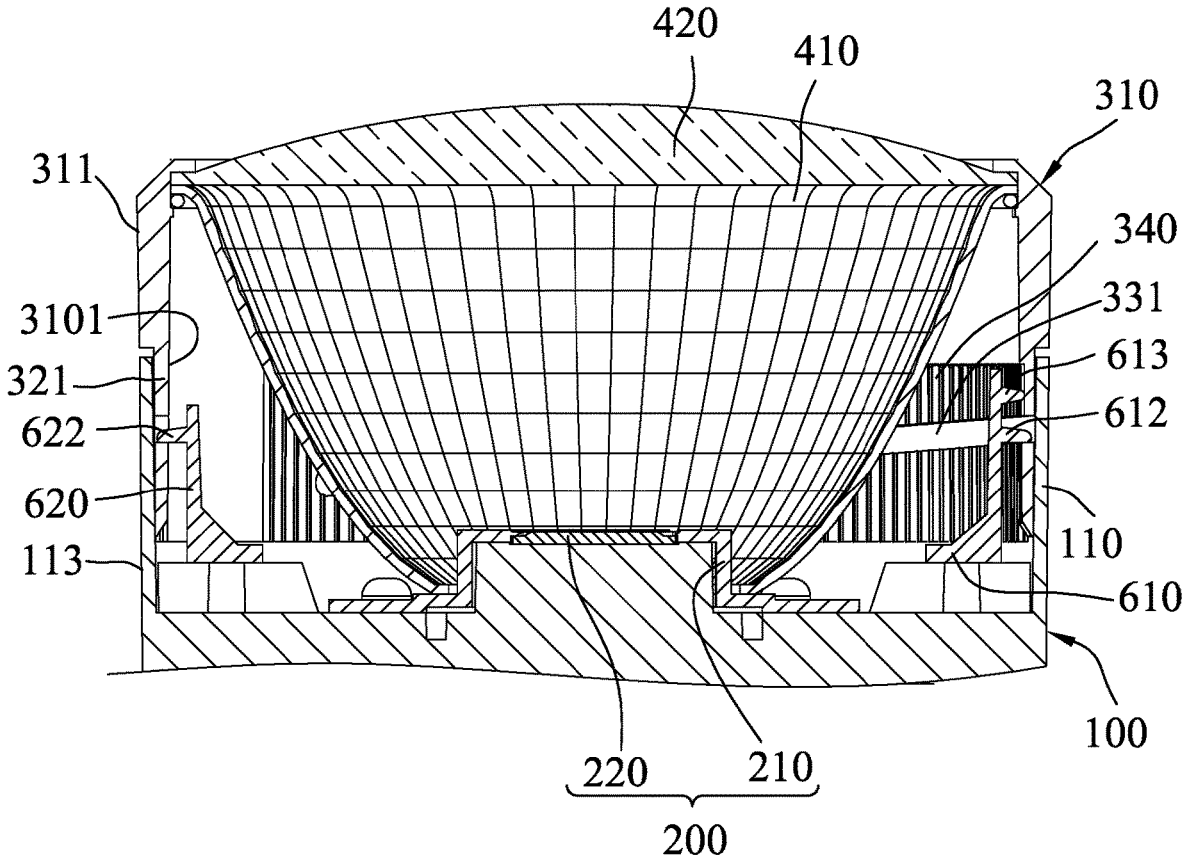
FIG. 17 is a partial sectional view of the second embodiment, but without the power driver.

Referring to FIGS. 15 to 17, the focus-adjustable lighting device according to a second embodiment of the present disclosure is shown to be generally similar to the first embodiment, except that the light guiding unit 400 of the second embodiment further includes a lens 420 disposed on top of the reflective cup 410, and an elastic ring 430 disposed on top of the lens 420 to fixedly position the reflective cup 410. The light source module 200 may be a Lambert light source. In this embodiment, the reflective cup 410 and the lens 420 are fixedly connected to and movable with the rotating member 310, such that when the rotating member 310 is rotated relative to the housing 100, the first limiting portion 612 and the third limiting portion 622 respectively slide along the semi-helical guide groove 331 and the semi-helical guide slot 332, and the second limiting portion 613 engages one of the concave grooves 341, so that the rotating member 310 can perform a stepwise rotation relative to the housing 100, thereby adjusting the distance between the reflective cup 410 and the light source module 200. In a variation of the second embodiment, the reflective cup 410 may be directly fixed on the housing 100, and the lens 420 may be fixedly connected to the rotating member 310, such that when the rotating member 310 is rotated relative to the housing 100, only the distance between the lens 420 and the light source module 200 is adjusted.

Figure 18:
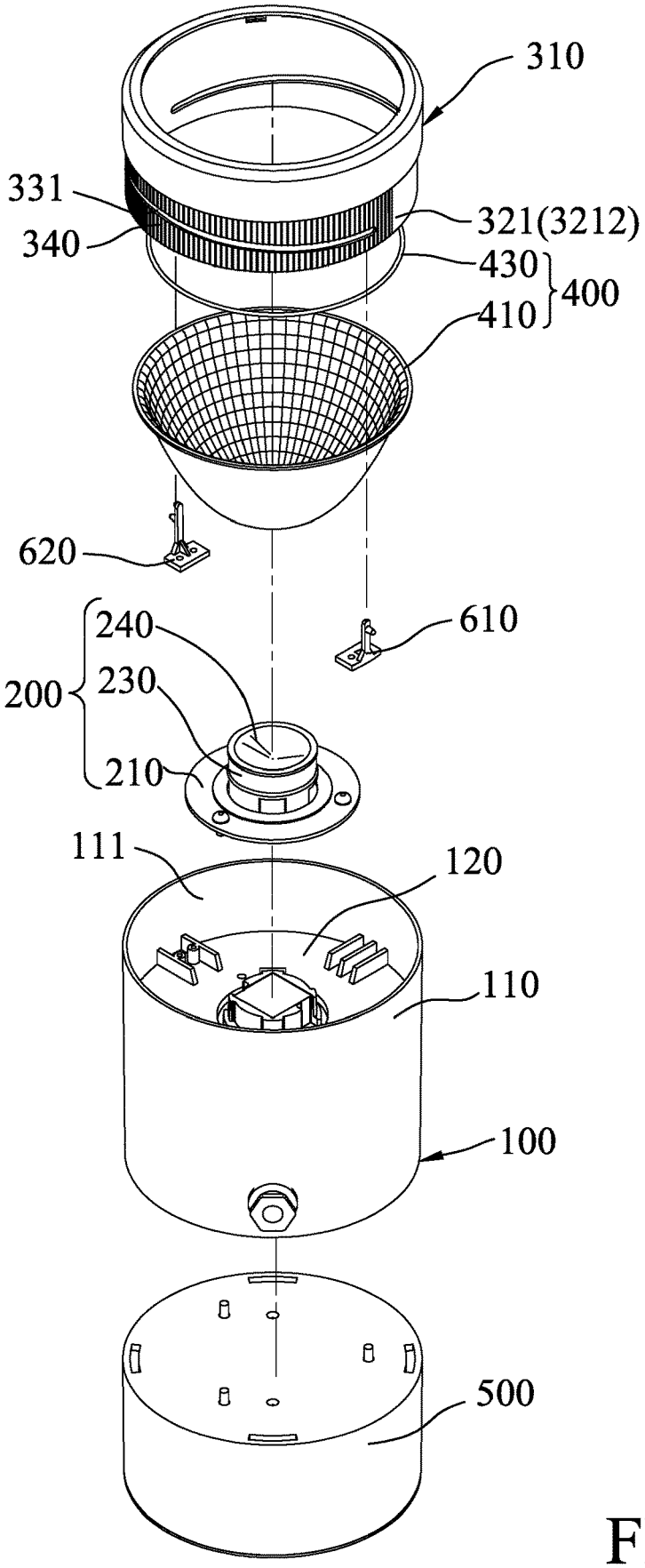
FIG. 18 is an exploded perspective view of a third embodiment of the focus-adjustable lighting device according to the present disclosure.
Figure 19:
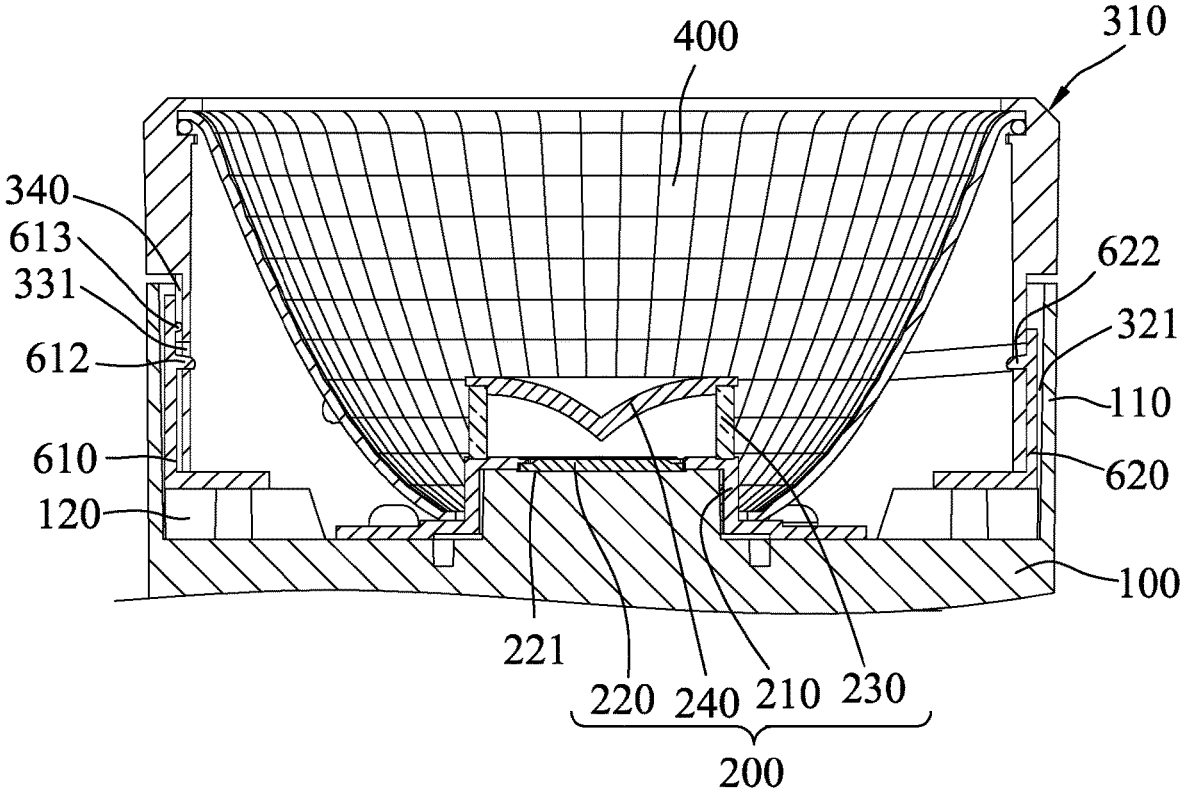
FIG. 19 is a partial sectional view of the third embodiment, but without the power driver.

Referring to FIGS. 18 and 19, the focus-adjustable lighting device according to a third embodiment of the present disclosure is shown to be generally similar to the first embodiment, except that, in the third embodiment, the semi-helical guide groove 331 and the engaging unit 340 are provided on the lower outer surface 3212 of the rotating member 310, and the first and second limiting members 610, 620 are located outside of the rotating member 310. To be specific, the first and second limiting members 610, 620 are fixed on the mounting plate 120 between the lower portion 321 of the rotating member 310 and the surrounding wall 110 of the housing 100. Alternatively, the first and second limiting members 610, 620 may be fixed on or integrally formed with the surrounding wall 110 of the housing 100. In another variation of the third embodiment, when the housing 100 serves as a heat sink, each of the first and second limiting members 610, 620 is made of a material different from that of the housing 100. In this case, the first and second limiting members 610, 620 are independently fixed on the housing 100 to easily achieve focus adjustment. In yet another variation of the third embodiment, when the housing 100 does not serve as the heat sink, the first and second limiting members 610, 620 may be integrally formed with the housing 100.

The efficiency of the focus-adjustable lighting device of this disclosure resides in that, by rotating the rotating member 310 relative to the housing 100, the relative position of the light guiding unit 400 and the light source module 200 can be adjusted, thereby changing the size of the beam angle and the light spot generated from the light source module 200. Further, the engaging unit 340 may be provided above or below the semi-helical guide groove 331 for engagement of the first limiting member 610 therewith, thereby restricting a stepwise rotation of the rotating member 310. Moreover, the angular rotation of the rotating member 310 may also be easily controlled, thereby facilitating precise adjustment of desired optical angle.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the present disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A focus-adjustable lighting device, comprising:
- a housing including a surrounding wall having an inner surrounding surface and an outer surrounding surface, and a mounting plate extending inwardly and radially from said inner surrounding surface;
- a light source module mounted on said mounting plate for emitting light;
- a focus-adjustable mechanism including
  - a rotating member disposed on and rotatable relative to said housing and having an inner surface, an outer surface opposite to said inner surface, a semi-helical guide groove formed in said inner surface, and an engaging unit provided immediately adjacent to said semi-helical guide groove, said engaging unit including a plurality of spaced-apart concave grooves formed in said inner surface and corresponding in position to said semi-helical guide groove, and
  - a first limiting member fixed on said housing and including a first limiting portion disposed in said semi-helical guide groove, and a second limiting portion spaced apart from said first limiting portion; and
- a light guiding unit disposed on and movable with said rotating member for reflecting light emitted from said light source module;
- wherein, when said rotating member is rotated relative to said housing, said first limiting portion slides along said semi-helical guide groove to control a distance between said light guiding unit and said light source module, and said second limiting portion engages one of said concave grooves to restrict a stepwise rotation of said rotating member.

2. The focus-adjustable lighting device as claimed in claim 1, wherein said rotating member further has a semi-helical guide slot extending through said inner surface and said outer surface thereof and diametrically opposite to said semi-helical guide groove, said focus-adjustable mechanism further including a second limiting member that is fixed on said housing opposite to said first limiting member and that has a third limiting portion disposed in said semi-helical guide slot.

3. The focus-adjustable lighting device as claimed in claim 1, wherein said concave grooves are equally spaced apart from one another to restrict equal stepwise rotation of said rotating member.

4. The focus-adjustable lighting device as claimed in claim 1, wherein said concave grooves are not equally spaced apart from one another to restrict unequal stepwise rotation of said rotating member.

5. The focus-adjustable lighting device as claimed in claim 1, wherein said semi-helical guide groove has an arc length less than half of a circumference of said rotating member, but larger than zero.

6. The focus-adjustable lighting device as claimed in claim 1, wherein said semi-helical guide groove has an arc length greater than one third of a circumference of said rotating member, but less than half of the circumference of said rotating member.

7. The focus-adjustable lighting device as claimed in claim 1, wherein said first limiting portion and said second limiting portion are parallel to each other.

8. The focus-adjustable lighting device as claimed in claim 1, wherein said first limiting portion has a length greater than that of said second limiting portion.

9. The focus-adjustable lighting device as claimed in claim 1, wherein said second limiting portion is made of an elastic material.

10. The focus-adjustable lighting device as claimed in claim 1, wherein each of said concave grooves has a width ranging from 1 mm to 20 mm.

11. The focus-adjustable lighting device as claimed in claim 1, wherein each of said concave grooves has a same width.

12. The focus-adjustable lighting device as claimed in claim 1, wherein said concave grooves have gradually changing widths.

13. The focus-adjustable lighting device as claimed in claim 1, wherein said semi-helical guide groove has a lower end portion proximate to said mounting plate, and an upper end portion distal to said mounting plate.

14. The focus-adjustable lighting device as claimed in claim 13, wherein said concave grooves have gradually decreasing widths from said lower end portion to said upper end portion.

15. The focus-adjustable lighting device as claimed in claim 13, wherein said engaging unit further includes a plurality of ribs each of which is disposed between two adjacent ones of said concave grooves.

16. The focus-adjustable lighting device as claimed in claim 15, wherein said ribs have gradually decreasing distances from said lower end portion to said upper end portion.

17. The focus-adjustable lighting device as claimed in claim 1, wherein said concave grooves extend transverse to said semi-helical guide groove.

18. The focus-adjustable lighting device as claimed in claim 15, wherein said second limiting portion is restricted in one of said concave grooves that is disposed between two adjacent ones of said ribs, and wherein, when said rotating member is rotated relative to said housing, said second limiting portion moves from one of said concave grooves to an adjacent one of said concave grooves and collides with a corresponding one of said ribs to emit sound as said second limiting portion moves from said one of said concave grooves to said adjacent one of said concave grooves.

19. The focus-adjustable lighting device as claimed in claim 13, wherein said lower end portion and said upper end portion of said semi-helical guide groove has a height difference of less than 20 mm.

20. The focus-adjustable lighting device as claimed in claim 1, wherein said light guiding unit includes a reflective cup.

21. The focus-adjustable lighting device as claimed in claim 20, wherein said light guiding unit further includes a lens disposed on top of said reflective cup.

22. The focus-adjustable lighting device as claimed in claim 20, wherein said light source module includes a light emitting diode (LED) package, a light source reflector disposed spacedly above said LED package, and a light-transmitting glass ring connected between said LED package and said light source reflector.

23. The focus-adjustable lighting device as claimed in claim 20, wherein said reflective cup defines a receiving space, and has a bottom portion formed with an opening communicating with said receiving space for insertion of said light source module into said receiving space.

24. The focus-adjustable lighting device as claimed in claim 23, wherein, when said rotating member is rotated relative to said housing and moves said reflective cup to a highest position relative to said housing, said bottom portion of said reflective cup is flush with a top portion of said LED package.

* * * * *